United States Patent [19]

Nakauchi

[11] Patent Number: 4,798,068

[45] Date of Patent: Jan. 17, 1989

[54] ELECTRICALLY CONTROLLED TYPE CYLINDER FOR LOCKS

[75] Inventor: Shunsaku Nakauchi, Mitaka, Japan

[73] Assignee: Kokusai Gijutsu Kaihatsu Kabushiki Kaisha, Tokyo, Japan

[21] Appl. No.: 124,249

[22] Filed: Nov. 23, 1987

[30] Foreign Application Priority Data

Nov. 27, 1986 [JP] Japan ..... 61-282455
Sep. 22, 1987 [JP] Japan ..... 62-145016[U]

[51] Int. Cl.[4] ..... E05B 47/00
[52] U.S. Cl. ..... 70/276; 70/277
[58] Field of Search ..... 70/27 L, 27 B, 277, 70/279-283, 365, 366; 340/542, 543; 361/172, 173; 307/10 AT

[56] References Cited

U.S. PATENT DOCUMENTS

| | | | |
|---|---|---|---|
| 1,695,518 | 12/1928 | Watson | 70/277 |
| 3,690,538 | 6/1972 | Curry | 70/277 |
| 4,603,564 | 8/1986 | Kleinhany | 70/277 |
| 4,712,390 | 12/1987 | Clarkson | 70/276 |

*Primary Examiner*—Robert L. Wolfe
*Attorney, Agent, or Firm*—James Creighton Wray

[57] ABSTRACT

In a cylinder for locks having an outer barrel and an inner cam with a keyhole. In order to lock the movement of the inner cam, a pin is provided in the outer barrel and the pin is engaged into a hole defined in the inner cam to lock the inner cam. The pin is urged by a spring so as to eject the pin from the hole and the pin is inserted into the hole by a driving mechanism utilizing a manual force. The engaging state of the pin with respect to the hole is held by a hold mechanism without any electric power consumption. The hold mechanism is responsive to an electric signal to release the engaging state between the pin and the hole.

10 Claims, 5 Drawing Sheets

ELECTRICALLY CONTROLLED TYPE CYLINDER FOR LOCKS

FIELD OF THE INVENTION

This invention relates to a cylinder lock which can be controlled by electric signals. To explain further, in detail, the locking and release of the rotating inner cam in relation to the outer barrel can be controlled by an electric signal.

BACKGROUND OF THE INVENTION

Up to now, a so called electric or electronic lock controlled by an electric signal involved a locking/unlocking action initiated by an electric motor or a solenoid. But, these actuators require power from a few watts to over ten watts and an actuating time of over 100 milliseconds therefore electric energy of over one Joule is necessary to institute the locking/unlocking action.

Up to now, the construction of the electronic lock has been such that the locking bolt has been directly attached to the locking actuator and also a large lock body has been required to install a large actuator. Also, power consumption is very high. Therefore, there is a limit for fitting to the door and maintenance is troublesome.

SUMMARY OF THE INVENTION

An object of the present invention is to provide a small sized, low power consumption electronic lock.

Another object of this invention is to provide an electronic cylinder for a lock where the condition of release or not between the inner cam and the outer barrel can be controlled by judging whether the electric signal received from the electronic key is correct or false.

Still another object of the present invention is to provide an electronic cylinder that cannot be picked by the use of a false mechanical key or any other mechanical means. The cylinder for locks contains an outer barrel and an inner cam with a keyhole such that when the means of operation is inserted in the said keyhole in the said inner cam, the said inner cam can rotate inside the said outer barrel.

According to the present invention in a cylinder for locks containing an outer barrel and an inner cam with a keyhole such that a rotating operation of said inner cam can be carried out inside said outer barrel by means of an operating means which is to be inserted in the said keyhole in the said inner cam, said cylinder comprises an arm component which is installed in an inner space of said outer barrel by a supporting member and supported such as to allow free see-saw or pivot action, a through hole defined in said outer barrel, an engaging hole placed in the said inner cam such that when said inner cam and said outer barrel are in the correct position both said through hole and said engaging hole are in alignment, a pin component mounted on said arm component, said pin component being for prohibiting relative movement of said inner cam to said outer barrel when said pin component is inserted into said engaging hole through said through hole a spring means for urging said arm component in a direction wherein said pin component is withdrawn from said engaging hole, a driving mechanism for driving said pin component into the said engaging hole overcoming the opposing force provided by the said spring means in response to a prescribed operation of said operating means and, a holding mechanism for holding a condition where said pin component is engaged into said engaging hole without consuming electric power when said pin component enters a predetermined state with respect to the engaging hole, said holding mechanism being capable of releasing said pin component from the held position when an electric signal is received.

The binding and release of the inner cam can be accomplished by the interaction of the pin component and the engaging hole. The pin is required to move 2–4 mm and large power is needed for the operation of an electro-magnetic device which has a 2–4 mm gap. Because the ampere turns required to get the necessary magnetic flux is proportional to the gap length and the required electric power is proportional to the square of the ampere turns the following is apparent.

The cylinder of this invention includes a self-holding electromagnetic device. To close the air gap of the holding device the means of operation is withdrawn from the keyhole situated in the inner cam by using human power. The release of the holding device from the held position requires the receipt of an electric signal from an external source.

When the holding device is in the held position the air gap is negligible and because of the aforementioned properties of the electro-magnetic device an extremely small amount of electric power is needed to move the device from the held position. Also, the operating time is extremely small and the physical construction of the electro-magnetic device is very small.

When the correct key is inserted into the cylinder lock an electric signal is received from the key and in response to the receipt of this signal the pin is withdrawn from the engaging hole by a spring means once the electro magnetic device has been moved from the held position thus allowing the rotation of the inner cam. The inner cam then be rotated by turning the key causing the retraction of the lock's locking bolt. The withdrawal of the pin is initiated by the use of electric power. This power is extremely small.

In order to return the holding device from the held open position either the inner cam is rotated or the key is withdrawn from the keyhole. This process does not use any electric power allowing substantial saving of power to be made. The withdrawal of the pin is therefore done using a combination of a spring means and an electric force which requires very little power.

In conjunction, the insertion of the pin into the engaging hole is done entirely by human force and a spring means resulting in zero power consumption. Because of the extremely low power consumption a small type battery can be used to supply power. This battery can either be installed in the cylinder or it can be installed in the key to supply power to the cylinder. If the battery is installed in the key it means an electronic cylinder lock can be produced that does not contain a power source, resulting in extremely low maintenance requirements. The invention will be better understood and the other objects and advantages thereof will be more apparent from the following detailed description of preferred embodiments with reference to the accompanying drawings.

DESCRIPTION OF PREFERRED EMBODIMENTS

Figure 1:
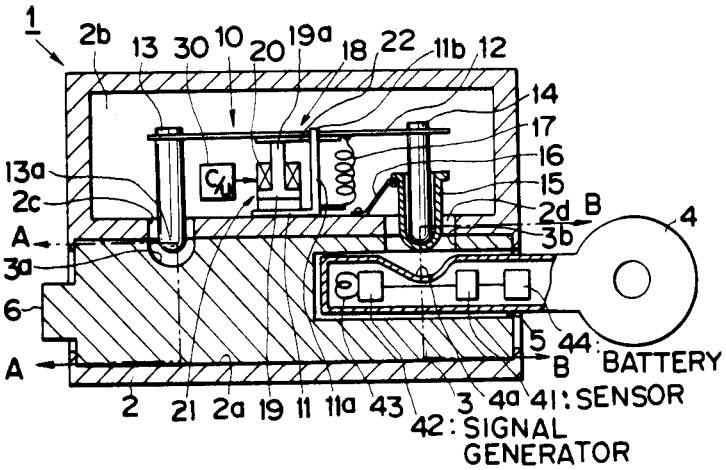
FIG. 1 is a sectional elevation to show the actual operation of an electrically controlled cylinder for locks under this invention.
Figure 2:
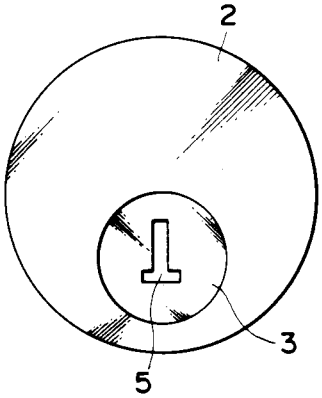
FIG. 2 is a front elevation of an electrically controlled cylinder as shown in FIG. 1.

The cylinder 1 according to this invention as shown in FIG. 1 and FIG. 2 is equipped with outer barrel 2 and inner cam 3 which can freely revolve inside a space 2a. Inner cam 3 has a key-hole 5 wherein an electronic key 4 is to be inserted. By twisting the electronic key 4, inner cam 3 can revolve inside a space 2a to a pre-determined angle. However, inner cam 3 is incorporated into outer barrel 2 by a commonly used method so that it does not move towards the Y-axis inside the space 2a. A plate protuberance 6 is attached to one end of inner cam 3, and when the inner cam 3 revolves, its revolutionary motion is transmitted through this protuberance 6 to a bolt inside a lock box which is not shown in FIG. 1 and FIG. 2.

Special mechanics 10 are installed in the space 2b inside an outer barrel 2 in order to work the binding and release of the relative revolutionary motion between the outer barrel 2 and the inner cam 3.

Figure 11:
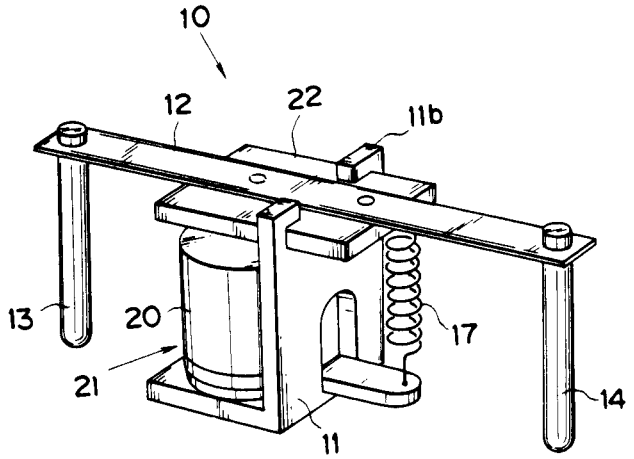
FIG. 11 is a perspective view of a special mechanics of FIG. 1.

The special mechanics 10 is shown in FIG. 11. The special mechanics 10 has an L-shaped supporting material 11 firmly fixed by some method to the inside wall of the space 2b. At the free end 11b of the vertical arm 11a of the L-shape supporting material 11, a long plate shaped spring arm is attached slightly off its center by means of a movable iron 22 such that it can move with see-saw or pivotal action.

On the barrel 2, a hole 2c is opened to hold the tip 13a of pin 13, and also in the inner cam there is a hole 3a in order to insert the tip 13a through the hole 2c.

This engaging hole 3a, as shown in picture 4, is oriented to form a line with the hole 2c in order to hold the outer barrel 2 and the inner cam 3 in their prescribed relative positions. When this is completed, the relative revolutionary motion between the inner cam 3 and the outer barrel 2 becomes impossible. The inner cam 3 is now in the locked state.

When the hole 2c and the engaging hole 3a are in perfect alignment, the electronic key 4 can be freely inserted or withdrawn from the keyhole 5 situated in the inner cam 3. The motion of the tip 13a of the pin 13 into the engaging hole 3a is governed by the motion of the electronic key 4 in the keyhole 5. For this purpose the base end of rod 14 is firmly fixed by some method to the other end of the movable arm 12. The tip 14a of the rod 14 is directed towards the inner cam 3 and this tip 14a is inserted into the keyhole 5 by passing the tip 14a through the holes 2a and 3b inside the outer barrel 2 and the inner cam 3 respectively so that the tip 14a comes into contact with the base of the concave groove 4a situated in the key 4 which is now situated in the keyhole 5.

Numeral reference 15 shows a sleeve which covers the tip 14a of rod 14 in order to protect against picking. The sleeve 15 is constantly pressed in contact with the tip 14a of the rod 14 by a plate spring 16. Therefore, normally the sleeve 15 will move in conjunction with the rod 14. There is a contracting coil spring 13 between the movable arm 12 and the inner wall of the space 26 and by the contracting power of the spring 17 the arm 12 is energized so that pin 13 is withdrawn from the engaging hole 3a. This situation is indicated in picture 1, where the tip 14a of the rod 14 together with the sleeve 15 is fitted in the concave groove 4a of the electronic key 4. As a result of this, the inner cam 3 can rotate freely in the space 2a by twisting the electronic key 4. The inner cam 3 is now in the unlocked state.

Figure 5:
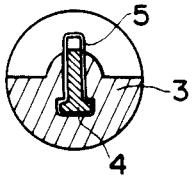
FIG. 5 is a sectional elevation of FIG. 1 along B—B line.

As you can see from FIG. 5, the hole 3b inside the inner cam 3 extends along the circumference for 180 degrees forming a groove in the inner cam 3. According to FIG. 1, the electronic key 4 can be used to either lock or unlock the inner cam 3 depending on your preference.

As shown in FIG. 1, when the electronic key 4 is withdrawn from the keyhole 5, the rod 14 is forced out of the concave groove 4a causing the movable arm 12 to pivot and forcing the tip 13a of pin 13 into the engaging hole 3a thus locking the inner cam 3. There is an electro-magnetic holding device 18 which is used to hold the arm 12 in the locked state and is also used to release the arm 12 in response to the receipt of an electric signal when requested. This consumes very little electric power.

The electro-magnetic holding device 18 is made of of a permanent magnet self-holding electro-magnet 21 which consists of a permanent magnet 19, a core 19a around which is wound a solenoid coil 20 and a steel plate 22 which is fixed to the movable arm 12. The steel plate 22 is oriented such that it faces the core 19a (see FIG. 11).

When the rod 14 is forced out of the groove 4a, in response to the operation of the key 4, the gap between the plate 22 and the core 19a becomes negligible. The steel plate 22 is then attracted and held by the permanent magnet 19 causing the inner cam 3 to become held in the locked state.

Then, using the control unit (c/u) 30 with its build-in power source an exciting current is supplied to the solenoid coil 20 in such a way so as to reduce the effective magnetic flux of the permanent magnet 19. Due to this the attracting force of the permanent magnet self-holding electro-magnet 21 becomes weaker than the opposing force of the coil spring 17 which causes the arm 12 to pivot lifting the tip 13a of pin 13 out of the engaging hole 3*a*. This means the inner cam 3 is now free to rotate.

The release current to be fed to the permanent magnet self-holding electro-magnet 21 is supplied by the control unit 30 with its built in power source, as shown in the picture, or it can be supplied through the manual operation of an on/off switch from an outside power source.

In the example as shown, the electronic key 4, as in FIG. 1 contains the following parts:

a sensor 41 to detect whether the electronic key 4 is inserted in the keyhole 5, a signal generator 42 to generate a predetermined code signal in response to the output signal of sensor 41, a coil 43 which is used to transmit the signal from the signal generator 42 to the control unit 30, a battery 44 which is built into the electronic key 4 to supply the power necessary for this operation.

Figure 10:
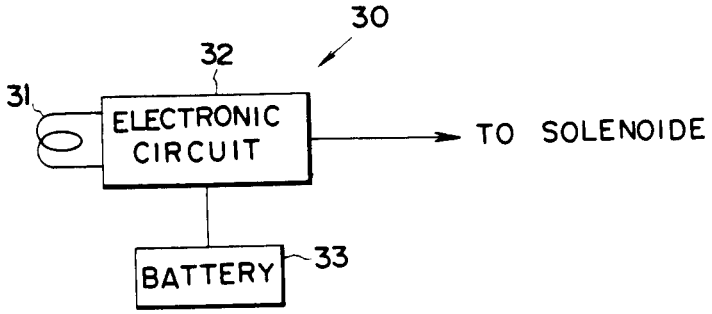
FIG. 10 is a block diagram of the control unit shown in FIG. 1.

On the other hand, the control unit 30, as shown in FIG. 10, contains a coil 31 which is used to receive the signal transmitted from coil 43. It also contains decoding circuitry 32 to determine if the received code is correct or not. If the code is correct the exiting current will be supplied to the solenoid 20. All the power necessary for this operation is supplied by the battery 33. Hence, it is obvious that the material making up the principal part of the electronic key 4 must be hard and robust, such as hard plastic, and into which the necessary electronic components, battery etc. can be moulded.

Hereunder, the operation of the electrically controlled cylinder will be described.

FIG. 1 shows the case where pin 13 is inserted in the engaging hole 3*a* such that the inner cam 3 cannot rotate. In this state the movable arm 22 is attracted by the magnetic flux of the permanent magnet 19 and held in this position without consuming power. While in this state if the electronic key 4 is inserted fully into the keyhole 5 the key 4 transmits a code signal which is received by the control unit 30 and processed. Only if the processed code signal is correct will an exciting current be fed to the solenoid 20.

Figure 3:
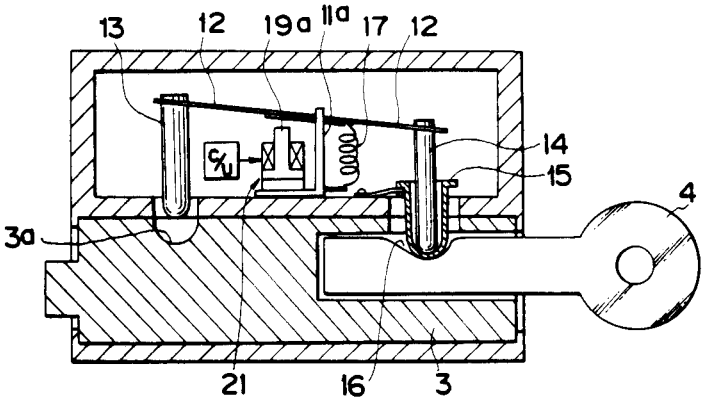
FIG. 3 is a sectional elevation of a cylinder to show that relative revolutionary motion of the inner cam and the outer barrel is possible.

This current flows in a direction such as to diminish the flux of the permanent magnet 19. Therefore the flux holding the armature 22 is diminished and the force of spring 17 becomes larger than that of the electro magnet 21, this forces armature 22 into the up position due to the pulling force of spring 17. This also causes pin 13 to be raised. The inner cam 3 is now free to rotate and the lock/unlock condition can be achieved. Pin 13 must move a distance of between 2–4 mm for the unlock state to be reached, and the contracting force of spring 17 is sufficient to do this without consuming electric power. The electric power needed to reduce the magnetic flux of the permanent magnet 19, based on the data taken from the test sample, was 0.10 watts. This is based on a holding force of the holding device of 50 grams and a spring force of 25 grams for the spring 17. 5 mS was found to be sufficient time for supplying power in order for the unlocking action to take place. This means there is an energy consumption of: 0.1 watts×5 mS=0.5 milliJoules. FIG. 3 shows the unlocked state of the cylinder where the pin 13 is in the raised position.

Figure 4:
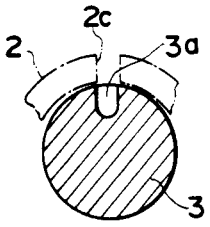
FIG. 4 is a sectional elevation of FIG. 1 along A—A line.

In addition, when pin 13 is in the raised position the rod 14 is, in the reverse manner, forced down into the concave groove 49 contained in the electronic key 4. In this state the inner cam 3 is free to rotate, so that when the electronic key 4 is twisted manually it forces the rod 14 to move upwards through the hole 2*a* according to FIG. 4. Also, when the inner cam 3 is twisted the lock body connecting plate 6 also rotates. Thus the bolt in the lock body can be retracted and extended by the rotation of the inner cam. This is not shown in FIG. 3. The locking and unlocking directions can be predetermined by specifying the direction of rotation of the inner cam 3. This design for the cylinder lock has now been used for a long time and is hence in the public domain.

When the locking or unlocking action is complete the inner cam 3 returns to its initial position and only in this position can the electronic key 4 be withdrawn from the keyhole 5. This method is also in the public domain as it has been used for many years. The withdrawal method is shown in FIG. 2.

In this state when the electronic key 4 is withdrawn the rod 14 is pushed upwards as it slides upward along the slope of the concave groove 4*a*. This causes the arm 12 to pivot forcing the plate 22 to come into contact with and be held by the permanent magnet 19. The amount of movement of the rod 14 must be sufficient to bring the plate 22 into contact with the permanent magnet 19. Therefore the concave groove 4*a* in the electronic key 4 must be designed with enough leeway to ensure that the operation is always performed. Depending on this leeway an excess movement may occur in the arm 12 therefore this arm is designed to flex slightly to overcome this problem. In continuation, as the arm 12 moves upward the plate 22 moves downward into the engaging hole 3*a*. This action prevents any relative motion of the inner cam 3 and the outer barrel 2 as they are now locked by the pin 13. In this way the cylinder can be relocked and held in this state without using any electric power.

From the previously mentioned test sample data the power needed to release the plate 22 from the held position was 0.1 watts. However, when a gap of 0.8 mm exists between the plate 22 and the core 19*a* of the electromagnetic device 21 a power of 7 watts and an operating time of 12 milliseconds is required in order to close the gap. This means the amount of energy required is:

$$7\ W \times 12\ mS = 84 \text{ milliJoules.}$$

In this way, this invention can save considerable amounts of energy.

The above explanation applies to the example outlined in FIG. 1. When the electronic key 4 is withdrawn with withdrawing power is used to return the plate 22 to the held position of the electromagnetic holding device and the inner cam 3 becomes impossible to rotate. This in turn means the lock cannot be opened.

In addition, based on the example in FIG. 1, the sleeve 15 which covers the tip of the rod 14 and is held by the plate spring 16 is used to prevent against so-called picking. When the rod 14 is in the raised position the sleeve 15 is used so that no external means can be introduced into the hole 2*a* to interfere with the rod 14 as there is no direct physical connection between the sleeve 15 and the rod 14.

Figure 6:
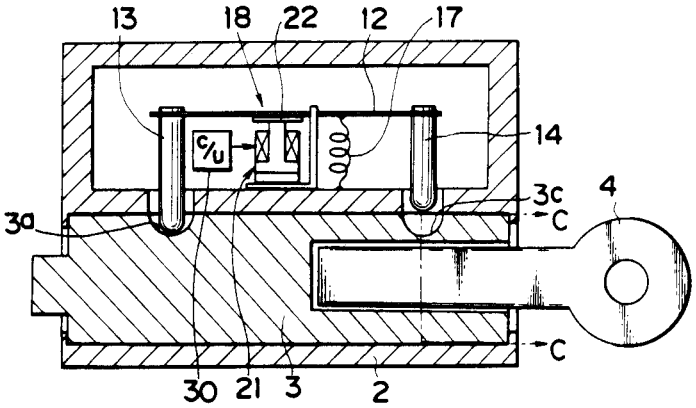
FIG. 6 is a sectional elevation to show another example of the actual operation of an electrically controlled cylinder for locks.
Figure 7:
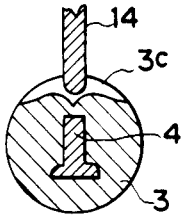
FIG. 7 is a sectional elevation of inner cam along C—C line taken from FIG. 6.

FIG. 6 is another represenation of this invention. The method outlined in FIG. 6 is such that when the inner cam 3 is rotated the rod 14 is pushed upwards causing the plate 22 to become held by the holding device. In the cylinder outlined in FIG. 6, denoted 1', the hole 2*d* of the outer barrel 2 corresponds to the groove 3*c* whose shape is outlined in FIG. 7. In FIG. 7 when the rod 14 is in the down position and the inner cam 3 is rotated the rod 14 is pushed upward causing the plate 22 to be attracted to and held by the magnetic holding device. When the pin 13 and the engaging hole 3*a* are not perfectly aligned the pin 13 cannot be inserted into the engaging hole 3*a*. In this case the plate spring 9 bends applying a downward force onto the pin 13. Under this force pin 13 slides along the outer surface of the inner cam 3 as it is rotated. When the inner cam 3 has been returned to the position where the key 4 can be withdrawn and the key 4 is then withdrawn the pin 13 is then pushed into the engaging hole 3*a*. The inner cam 3 is now in the locked state. On top of this as you can see from FIG. 6, the concave groove 4*a* in the key 4 is not necessary for this operation.

Figure 8:
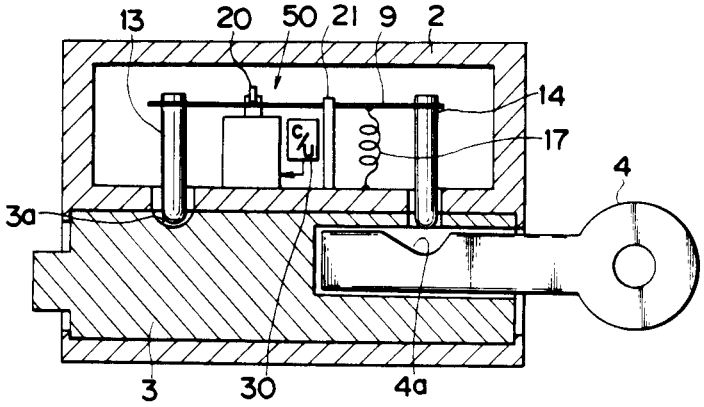
FIG. 8 is a sectional elevation to show an additional example of actual operation.

The apparatus shown in FIG. 8 is a mechanical type holding device. With the previously mentioned electromagnetic device it was stated that the operating power increases in proportion with the square of the length of the air gap between the steel plate armature 22 and the core of the electromagnet 19*a*. Therefore if an electromagnet where the air gap is small is used only a small operating power is necessary in order to move the pin 13.

The apparatus outlined in FIG. 8 differs from that outlined in FIG. 1 in the method of the construction of the holding device 18. In FIG. 8 the holding device is a mechanical arrangement whereas in FIG. 1 the holding device is a permanent magnet electromagnetic holding device.

Figure 9A:
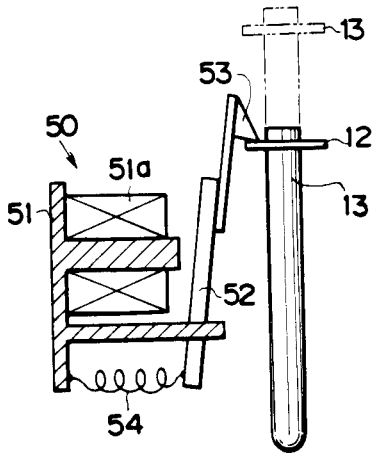
FIGS. 9A and 9B are enlarged and detailed pictures of holding type electro magnetic device as shown in FIG. 8.
Figure 9B:
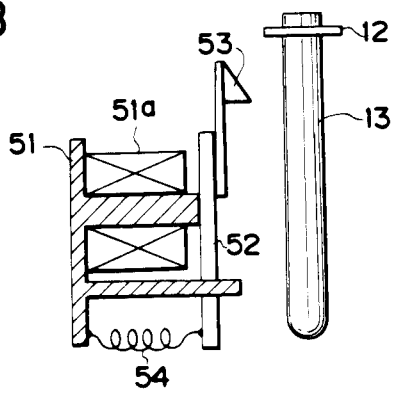

The holding device 50 sohwn in FIG. 8, as shown in detail in FIGS. 9*a* and 9*b* consists of an electromagnet 51 with an exciting coil, an armature 52 such that it can be hooked to the arm 12 which is attached to the pin 13 when the pin 13 is in the down i.e. locked position and a spring 54 which is fixed between the electromagnet 51 and the arm 52 so that it applies a force to the arm 52 in a direction such as to move the arm 52 towards the pin 13.

The case shown in FIG. 9*a* is that where the electromagnetic device 50 is not energized. As the key 4 is withdrawn from the keyhole 5 the pin 13 is forced downwards with the point of the hook 53 sliding along the side of the pin 13 in a direction opposing the direction of the spring force 54. Once the arm 12 has completely passed the tip of the hook 53 the spring 54 applies a force such that the hook 53 is once again brought into contact with the side of the pin 13 such that the pin 13 cannot return from this position. The tip 13*a* of pin 13 is now inserted into the engaging hole 3*a* and is held in this locked state. Therefore the inner cam 3 cannot be rotated and the main lock body cannot be operated.

The case shown in FIG. 9*b* is that where the electromagnetic device is energized. When electric current is applied to the electromagnetic device 50 the arm 52 is attracted toward the core releasing the hook 53 holding the arm 12. The arm 12 is now free to move and under the force supplied by the spring 17 the arm 12 moves in an upward direction causing the pin 13 to be withdrawn from the engaging hole 3*a*. The inner cam 3 is now free to rotate. The main lock body connected to the plate 6 can now be operated by twisting the key 4.

According to the above explanation contained in FIGS. 8–9*b* the amount of movement of the pin 13 is 2–4 mm however, the amount of movement of the hook 53 is only 0.2–0.5 mm therefore the amount of electric power required to operate the electromagnetic device is small.

To return the pin 13 from the case outlined in FIG. 9*b* to that outlined in FIG. 9*a* the electronic key 4 is withdrawn from the keyhole 5 in the same way as was applied to the case in FIG. 1 where human power only was used. In this way absolutely no electric power is consumed. Therefore, in the case outlined above, as was the case for that explained in FIG. 1, the power consumption of the complete invention is extremely small.

I claim:

1. A cylinder for locks containing an outer barrel and an inner cam with a keyhole such that a rotating operation of said inner cam can be carried out inside said outer barrel by means of an operating means which is to be inserted in the said keyhole in the said inner cam, said cylinder comprising:

an arm component which is installed in an inner space of said outer barrel by a supporting member and supported such as to allow free see-saw or pivot action, a through hole defined in said outer barrel, an engaging hole placed in the said inner cam such that when said inner cam and said outer barrel are in the correct position both said through hole and said engaging hole are in alignment, a pin component mounted on said arm component, said pin component being for prohibiting relative motion of said inner cam to said outer barrel when said pin component is inserted into said engaging hole through said through hole, a spring means for urging said arm component in a direction where said pin component is withdrawn from said engaging hole, a driving mechanism for driving said pin component into the said engaging hole overcoming the opposing force provided by the said spring means in response to a prescribed operation of said operating means and, a holding mechanism for holding a condition where said pin component is engaged into said engaging hole without consuming electric power when said pin component enters a predetermined state with respect to the engaging hole, said holding mechanism being capable of releasing said pin component from the held position when an electric signal is received.

2. An apparatus as claimed in claim 1 wherein the said arm component is formed from a flat spring.

3. An apparatus as claimed in claim 1 wherein said spring means is situated between said arm component and said outer barrel in a position such that the force of said spring means is directed to withdraw said pin component attached to said arm component from said engaging hole.

4. An apparatus as claimed in claim 1 wherein said driving mechanism has an operating rod rigidly mounted to the opposite end of said arm component with respect to the supporting member and a passage means for providing a passage through which the tip portion of said operating rod can be inserted into said keyhole when the held condition is not maintained by said holding mechanism, whereby said pin component is engaged into said engaging hole when the tip portion of said operating rod is ejected from the keyhole in response to the prescribed operation of said operating means in the keyhole.

5. An apparatus as claimed in claim 1 wherein said driving mechanism has an operating rod rigidly mounted to the opposite end of said arm component with respect to the supporting member, a passage means defined in said outer barrel for providing a passage through which the tip portion of said operating rod can be inserted into a receiving space of said inner cam when the held condition is not maintained by said holding mechanism and a curved surface defined on a surface of said inner cam for regulating the position of the tip portion of said operating rod in the receiving space in accordance with an angular position of said inner cam, whereby said pin component is inserted into said engaging hole when said inner cam is positioned at a prescribed position by the operating means.

6. An apparatus as claimed in claim 1 in wherein said holding mechanism has a magnetic component fixed to said arm component, a permanent magnet for attracting and holding said magnetic component when said pin component enters a prescribed state with respect to said engaging hole by the driving operation of said driving mechanism and a solenoid coil for producing a magnetic field for reducing the magnetic field produced by said permanent magnet in response to the application of the electric signal whereby the held condition caused by said permanent magnet is released.

7. An apparatus as claimed in claim 1 wherein said holding mechanism has a latching mechanism for holding said pin component with said pin component engaged in said engaging hole, said latching mechanism being arranged in such a way that said pin component is allowed to move in the direction toward said engaging hole and an electromagnetic means for providing force necessary to release said latching mechanism so that said pin component can be withdrawn from said engaging hole.

8. An apparatus as claimed in claim 1 further comprising a means for generating a code signal which is incorporated into said operating means, and a control means for receiving the code signal and providing an electric signal for releasing the held condition of said holding mechanism when a content of said code signal is confirmed to be identical with a prescribed contents.

9. An apparatus as claimed in claim 8 wherein said control means and a desired power source are contained in said inner space located in said outer barrel.

10. An apparatus as claimed in claim 8 wherein a power source necessary to operate said means for generating a code signal is incorporated into said means of operation.

* * * * *